United States Patent [19]

Fan

[11] Patent Number: 4,488,600

[45] Date of Patent: Dec. 18, 1984

[54] RECOVERY OF HEAVY OIL BY STEAM FLOODING COMBINED WITH A NITROGEN DRIVE

[75] Inventor: Mark J. Fan, Irving, Tex.

[73] Assignee: Mobil Oil Corporation, New York, N.Y.

[21] Appl. No.: 381,236

[22] Filed: May 24, 1982

[51] Int. Cl.[3] ..... E21B 43/24

[52] U.S. Cl. ..... 166/263; 166/272

[58] Field of Search ..... 166/272, 263

[56] References Cited

U.S. PATENT DOCUMENTS

| | | | |
|---|---|---|---|
| 3,042,114 | 7/1962 | Willman | 166/272 |
| 3,259,186 | 7/1966 | Dietz | 166/263 |
| 3,353,598 | 11/1967 | Smith | 166/272 X |
| 3,357,487 | 12/1967 | Gilchrist et al. | 166/272 X |
| 3,358,759 | 12/1967 | Parker et al. | 166/263 |
| 3,375,870 | 4/1968 | Satter et al. | 166/263 X |
| 3,425,492 | 2/1969 | Gilchrist | 166/272 |
| 4,324,291 | 4/1982 | Wong et al. | 166/263 X |
| 4,385,662 | 5/1983 | Mullins et al. | 166/263 |

*Primary Examiner*—George A. Suchfield

*Attorney, Agent, or Firm*—Alexander J. McKillop; Michael G. Gilman; Malcolm D. Keen

[57] ABSTRACT

A method for the recovery of viscous oil from a subterranean, viscous oil-containing formation in which nitrogen is injected into the oil-containing formation following a steam flood.

2 Claims, No Drawings

RECOVERY OF HEAVY OIL BY STEAM FLOODING COMBINED WITH A NITROGEN DRIVE

FIELD OF THE INVENTION

The present invention relates to a process for the recovery of oil from subterranean, viscous oil-containing formations in which steam is employed as the oil-driving medium followed by the injection of nitrogen as the displacement fluid.

BACKGROUND OF THE INVENTION

Many oil reservoirs have been discovered which contain vast quantities of oil, but little or no oil has been recovered from many of them because the oil present in the reservoir is so viscous that it is essentially immobile at reservoir conditions, and little or no petroleum flow will occur into a well drilled into the formation even if a natural or artificially induced pressure differential exists between the formation and the well. Some form of supplemental oil recovery process must be applied to these formations which decreases the viscosity of the oil sufficiently that it will flow or can be dispersed through the formation to a production well and therethrough to the surface of the earth. Thermal recovery techniques are quite suitable for viscous oil formations, and steam flooding is the most successful thermal oil recovery technique yet employed commercially.

Steam may be utilized for thermal stimulation for viscous oil production by means of a steam drive or steam throughput process, in which steam is injected into the formation on a more or less continuous basis by means of an injection well and oil is recovered from the formation from a spaced-apart production well. The injected steam not only serves to drive the oil into the production well but it also condenses giving up its heat to the formation thereby reducing the viscosity of the oil and enhancing its recovery. Injection of steam and production of oil is continued until steam breakthrough occurs at the production well. Continued injection of steam into the formation after steam breakthrough will accomplish very little economical oil recovery because of the unfavorable ratio of oil to water at the production well.

The present invention is a modified steam injection process that reduces the steam injection period and the amount of steam injected by introducing nitrogen into the formation after steam has been injected for a predetermined period of time. The replacing of steam by nitrogen decreases the cost of production of each barrel of oil because the cost of generating nitrogen used for flooding the formation in the present invention is only one-third of the price for steam generation. Also, the use of nitrogen can also prevent formation damage, well corrosion, and the government restriction of air pollution in such areas as California.

SUMMARY

The present invention relates to a method for the recovery of viscous oil from a subterranean, viscous oil-containing formation penetrated by at least one injection well and one spaced-apart production well comprising injecting steam into the formation via the injection well for a predetermined period of time and producing fluids including oil from the production well and thereafter injecting nitrogen into the formation via the injection well and producing fluids including oil from the production well.

DESCRIPTION OF THE PREFERRED EMBODIMENT

In carrying out my invention, steam is injected into a relatively thick subterranean, viscous oil-containing formation via at least one injection well to fluid communication with a substantial portion of the formation and fluids including oil are recovered from the formation via at least one spaced-apart production well in fluid communication with a substantial portion of the formation. The injection and production wells are completed in a conventional manner, such as perforating the wells throughout the full or a substantial amount of the vertical thickness of the formation.

Injection of steam and production are continued for a predetermined period of time depending upon the characteristics of the formation or preferably until steam breakthrough occurs at the production well which will provide the highest temperature to which the formation will be heated. During steam injection, the steam not only serves as a driving force to cause oil to be displaced through the formation toward the production well from which it is recovered, but it also lowers the viscosity of the oil over a substantial portion of the formation, thus enhancing production over a shortened period of time.

For economical reasons, the preferred steam employed in this process is saturated steam, i.e. its quality is less than 100%. As a general rule, the desirable temperature of the steam will generally be in the range of 400° F. to 700° F.

Once steam has been injected for a predetermined period of time or until steam breakthrough occurs at the production well, injection of steam is terminated and nitrogen is injected into the formation via the injection well and fluids including oil are recovered from the formation via the production well. The injected nitrogen displaces the oil reduced in viscosity by the heat of the steam through the formation into the production well.

Injection of nitrogen and the recovery of fluids including oil via the production well is continued until the recovery of oil is unfavorable.

In another embodiment of the invention, following the injection of steam and prior to the injection of nitrogen, both the injection well and the production well may be shut in to allow the formation to undergo a soak period for a predetermined length of time depending upon the characteristics of the formation.

While the invention has been described in terms of a simple injection well and a single spaced apart production well, the method according to the invention may be practiced using a variety of well patterns. Any number of wells, which may be arranged according to any pattern, may be applied in using the present method as illustrated in U.S. Pat. No. 3,927,716 to Burdyn et al.

From the foregoing specification one skilled in the art can readily ascertain the essential features of this invention and without departing from the spirit and scope thereof can adapt it to various diverse applications. It is my intention and desire that my invention be limited only by those restrictions or limitations as are contained in the claims appended immediately hereinafter below.

What is claimed is:

1. A method for the recovery of viscous oil from a subterranean, viscous oil-containing formation penetrated by at least one injection well and one spaced-apart production well, comprising:

(a) injecting steam into the formation via said injection well until vapor phase steam production occurs at the production well and producing fluids including oil from said production well;

(b) terminating injection of the steam upon the occurrence of vapor phase steam production at the production well; and (c) thereafter injecting nitrogen into the formation via said injecton well and producing fluids including oil from said production well.

2. The method of claim 1 wherein said wells are shut-in and the formation undergoes a soak period after step (b).

* * * * *